US011176919B2

(12) United States Patent
Gavryushin et al.

(10) Patent No.: US 11,176,919 B2
(45) Date of Patent: Nov. 16, 2021

(54) ACOUSTIC FILLER INCLUDING ACOUSTICALLY ACTIVE BEADS AND EXPANDABLE FILLER

(71) Applicant: Apple Inc., Cupertino, CA (US)

(72) Inventors: Andrey Gavryushin, Germering (DE); Veronika Wagner, Munich (DE); Juergen Sauer, Munich (DE)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/986,061

(22) Filed: Aug. 5, 2020

(65) Prior Publication Data

US 2020/0372890 A1 Nov. 26, 2020

Related U.S. Application Data

(62) Division of application No. 16/184,888, filed on Nov. 8, 2018, now Pat. No. 10,783,867.

(51) Int. Cl.

| | |
|---|---|
| ***G10K 11/00*** | (2006.01) |
| ***H04R 1/02*** | (2006.01) |
| ***H04R 31/00*** | (2006.01) |
| ***G10K 11/162*** | (2006.01) |
| ***G10K 11/16*** | (2006.01) |

(52) U.S. Cl.
CPC ..... *G10K 11/002* (2013.01); *G10K 11/161* (2013.01); *G10K 11/162* (2013.01); *H04R 1/02* (2013.01); *H04R 31/00* (2013.01)

(58) Field of Classification Search
CPC combination set(s) only.
See application file for complete search history.

(56) References Cited

U.S. PATENT DOCUMENTS 3,615,972 A * 10/1971 Morehouse, Jr. ..... C08J 9/32 156/79
4,127,751 A * 11/1978 Kinoshita ..... H04R 1/288 181/146
5,755,952 A * 5/1998 Hirai ..... B01D 53/02 205/768

(Continued)

FOREIGN PATENT DOCUMENTS

CN 101416528 4/2009
CN 106488365 3/2017

(Continued)

OTHER PUBLICATIONS

Evaluation Report for Utility Model Patent for Chinese Patent No. ZL2019218555794 dated Jul. 29, 2020, 18 pages.

*Primary Examiner* — Angelica M McKinney
(74) *Attorney, Agent, or Firm* — Womble Bond Dickinson (US) LLP

(57) ABSTRACT

Aspects are disclosed of a filler for occupying a volume. The filler includes an expandable filler positioned in the volume so that it occupies a percentage of the volume. The expandable filler can permanently expand from a first dimension to a second dimension upon the application of an expansion trigger. The filler also includes an acoustic filler made up of a plurality of acoustically active beads positioned with the expandable filler in the volume so that the acoustic filler can adsorb gas flowing into the volume. Other embodiments are disclosed and claimed.

17 Claims, 11 Drawing Sheets

(56) References Cited

U.S. PATENT DOCUMENTS

| | | | | |
|---|---|---|---|---|
| 5,955,386 | A * | 9/1999 | Horton | B32B 5/02 427/209 |
| 7,524,556 | B2 * | 4/2009 | Fujimoto | B29C 44/0415 428/310.5 |
| 7,770,693 | B2 * | 8/2010 | Uejima | G11B 33/00 181/294 |
| 9,771,693 | B2 * | 9/2017 | Zhang | B29C 65/50 |
| 10,369,766 | B2 * | 8/2019 | Sasaki | B32B 9/048 |
| 2011/0277911 | A1 * | 11/2011 | Allen | G10K 11/16 156/79 |
| 2013/0306655 | A1 * | 11/2013 | Takushima | B01D 53/0407 220/592.25 |
| 2016/0127821 | A1 * | 5/2016 | Bay | H04R 29/001 381/353 |
| 2016/0332583 | A1 * | 11/2016 | Subat | H04R 1/2811 |
| 2017/0041704 | A1 * | 2/2017 | Herold | H04R 1/2853 |
| 2017/0064438 | A1 * | 3/2017 | Wilk | H04R 1/2811 |
| 2017/0234005 | A1 * | 8/2017 | Yuasa | E04B 1/7038 52/406.2 |
| 2017/0353785 | A1 * | 12/2017 | Choi | H04R 1/288 |
| 2020/0092636 | A1 * | 3/2020 | Sauer | G06F 1/1605 |

FOREIGN PATENT DOCUMENTS

| | | |
|---|---|---|
| CN | 107147961 | 9/2017 |
| CN | 107484087 | 12/2017 |
| EP | 2424270 | 5/2014 |
| WO | 2009014015 | 1/2009 |
| WO | 2016186717 | 11/2016 |

* cited by examiner

ACOUSTIC FILLER INCLUDING ACOUSTICALLY ACTIVE BEADS AND EXPANDABLE FILLER

CROSS-REFERENCE TO RELATED APPLICATIONS

This application is a division of pending U.S. application Ser. No. 16/184,888, filed Nov. 8, 2018.

TECHNICAL FIELD

The disclosed aspects relate generally to audio speakers and in particular, but not exclusively, to audio speakers that can use a combination of acoustically active and expandable fillers in their back volumes to improve loudspeaker performance.

BACKGROUND

Loudspeakers include a back volume and a membrane or diaphragm that oscillates and emits sound when driven by an electromagnetic transducer. A variety of different forces act on the membrane while it is being moved, distorting its intended acceleration by the electromagnet and thus distorting the sound wave it emits. Reduction of these additional membrane forces leads to improved sound quality.

One of the forces acting on the membrane results from pressure fluctuations in the back volume due to compression and decompression of air by the moving membrane. These pressure fluctuations can be reduced by increasing the space of the back volume—e.g., by making it larger. But in hand-held devices such as cell phones, increasing the size of the back volume is possible only to a minor degree because these devices should be kept conveniently small.

In the context of this disclosure, "acoustically active bead" means any entity with various geometrical shapes and capable of adand desorption. The sorptive material can for example comprise zeolites, active carbon or metal organic frameworks (MOFs).

SUMMARY

Aspects are described of an audio speaker. The audio speaker includes a housing defining a back volume behind a speaker driver, so that the speaker driver can convert an electrical audio signal into a sound and the sound can propagate through a gas in the back volume. A permeable partition divides the back volume into a rear cavity defined between the speaker driver, the housing, and the permeable partition and an adsorption cavity defined between the housing and the permeable partition. The permeable partition includes a plurality of holes that place the rear cavity in fluid communication with the adsorption cavity to allow the gas to flow between the rear cavity and the adsorption cavity. An expandable filler is positioned in the adsorption cavity so that it occupies a percentage of the volume of the adsorption cavity. The expandable filler can permanently expand from a first dimension to a second dimension upon the application of an expansion trigger. An acoustic filler is positioned with the expandable filler in the adsorption cavity to adsorb the gas, the acoustic filler comprising a plurality of acoustically active beads.

Aspects are described of a filler for occupying a volume. The filler includes an expandable filler positioned in the volume so that it occupies a percentage of the volume. The expandable filler can permanently expand from a first dimension to a second dimension upon the application of an expansion trigger. An acoustic filler is positioned with the expandable filler in the volume so that the acoustic filler can adsorb gas flowing into the volume. The acoustic filler comprises a plurality of acoustically active beads.

Aspects are described of a method including inserting an expandable filler in a back volume of an audio speaker, so that the expandable filler occupies a percentage of the back volume. An acoustic filler is inserted in at least a portion of the back volume not occupied by the expandable filler so that the acoustic filler can adsorb gas flowing into the back volume; the acoustic filler comprising a plurality of acoustically active beads. An expansion trigger is applied to the expandable filler and the acoustic filler so that the expandable filler permanently expands from a first dimension to a second dimension to reduce movement of the acoustically active beads in the back volume.

Aspects are described of an expandable material. The expandable material includes a solvent, a plurality of polymer granules mixed into the solvent, a polymeric binder, and a modifier that is a chemically inert density-regulating compound or a viscosity-regulating compound.

BRIEF DESCRIPTION OF THE DRAWINGS

Non-limiting and non-exhaustive aspects of the present invention are described with reference to the following figures, wherein like reference numerals refer to like parts throughout the various views unless otherwise specified.

FIG. 4A shows the expandable beads in their unexpanded state, FIG. 4B in their expanded state. FIG. 4C illustrates expansion of a single expandable bead.

FIG. 5A shows the coating in its unexpanded state, FIG. 5B in its expanded state.

DETAILED DESCRIPTION

The disclosure below describes aspects of a loudspeaker including a back volume with an acoustic filler and an expandable filler.

Specific details are described to provide an understanding of the disclosed aspects, but one skilled in the art will recognize that the invention can be practiced without one or more of the described details or with other methods, components, materials, etc. In some instances, well-known structures, materials, or operations are not shown or described in detail but are nonetheless encompassed within the scope of the invention.

Reference throughout this specification to "one aspect" or "an aspect" means that a described feature, structure, or characteristic can be included in at least one described aspect, so that appearances of "in one aspect" or "in an aspect" do not necessarily all refer to the same aspect. Furthermore, the particular features, structures, or characteristics can be combined in any suitable manner in one or more aspects.

One approach to reducing back volume pressure fluctuations for handheld devices is to place absorbent materials like carbon black or zeolites into the back volumes. It has been shown that such materials can virtually increase the back volume—in other words, their presence in the back volume enhances loudspeaker performance as if the speaker's back volume had been made bigger.

Loudspeaker

Figure 1:
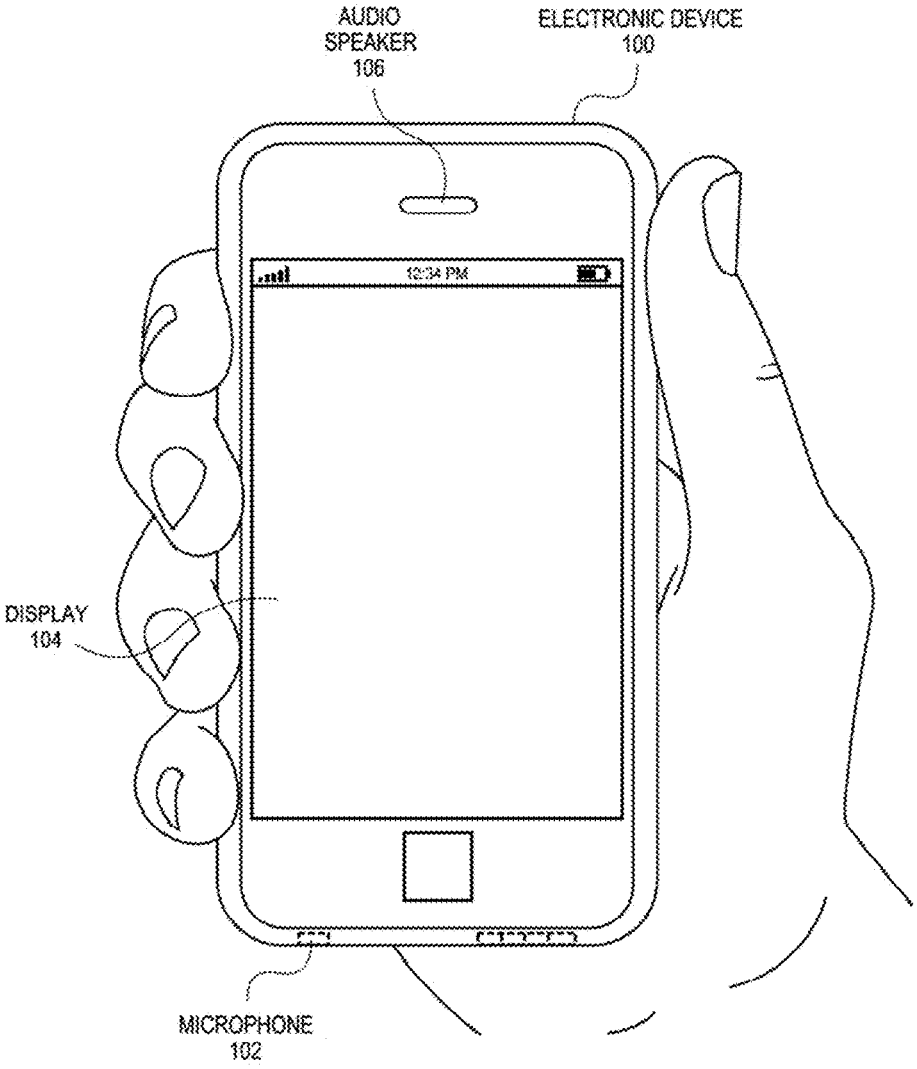
FIG. 1 is a pictorial view of an aspect of an electronic device.

FIG. 1 illustrates an aspect of an electronic device 100. Electronic device 100 can be a smartphone device in one aspect, but in other aspects can be any other portable or stationary device or apparatus, such as a laptop computer or a tablet computer. Electronic device 100 can include various capabilities to allow the user to access features involving, for example, calls, voicemail, music, e-mail, internet browsing, scheduling, and photos. Electronic device 100 can also include hardware to facilitate such capabilities. For example, an integrated microphone 102 can pick up the voice of a user during a call, and an audio speaker 106, e.g., a micro loudspeaker, can deliver a far-end voice to the near-end user during the call. Audio speaker 106 can also emit sounds associated with music files played by a music player application running on electronic device 100. A display 104 can present the user with a graphical user interface to allow the user to interact with electronic device 100 and/or applications running on electronic device 100. Other conventional features are not shown but can of course be included in electronic device 100.

Figure 2A:
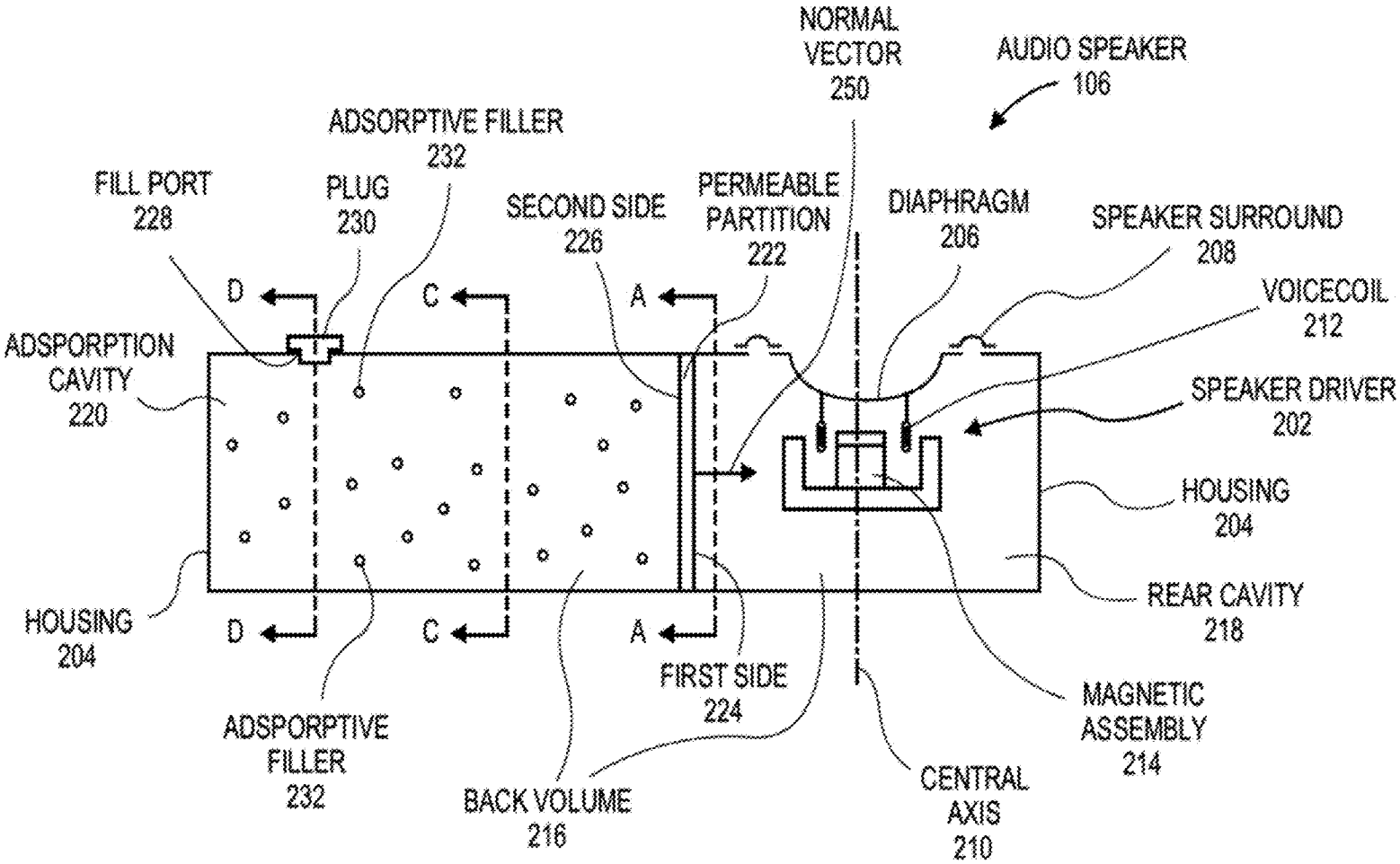
FIGS. 2A-2B are sectional views of aspects of an audio micro-loudspeaker for an electronic device.
Figure 2B:
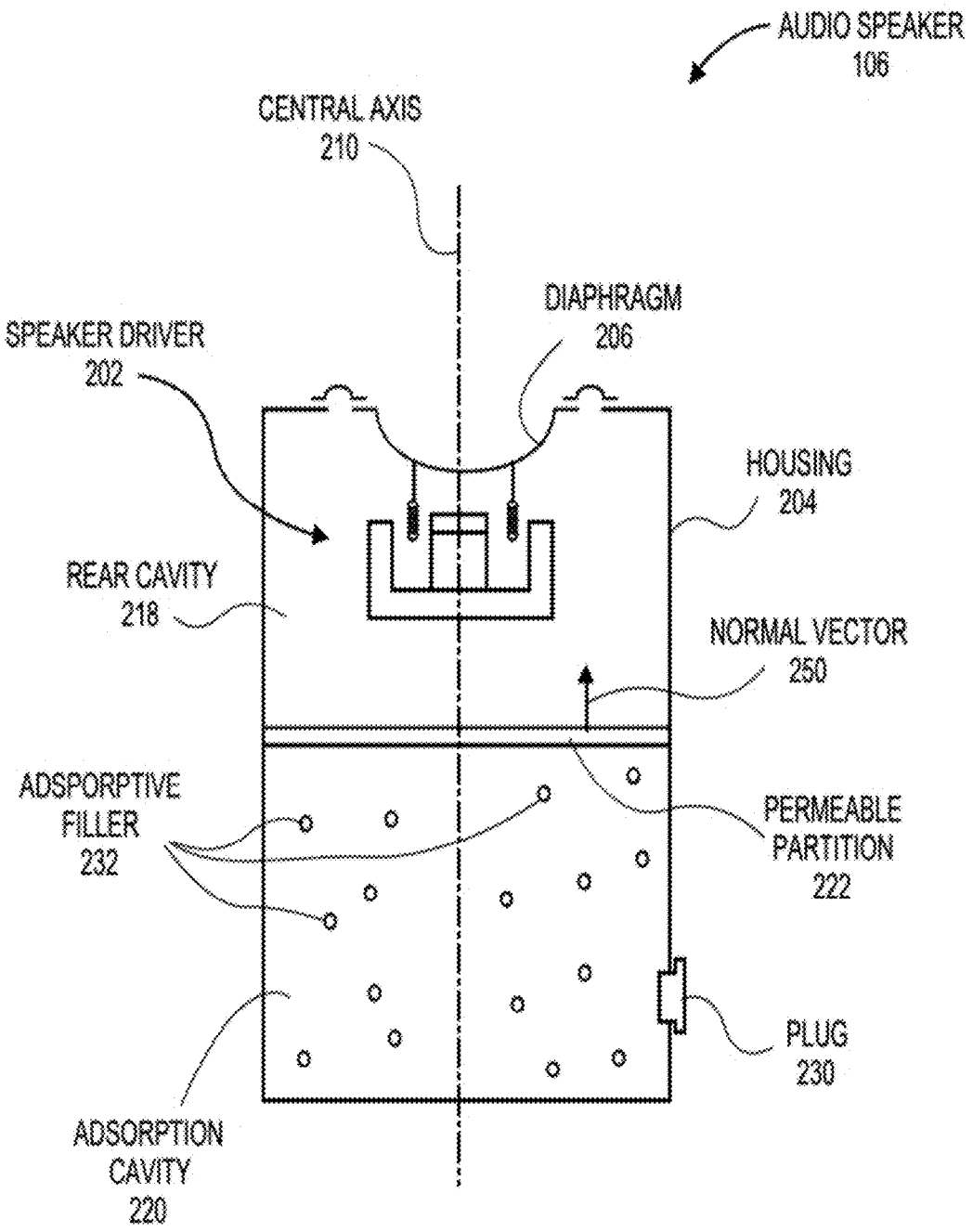

FIGS. 2A-2B illustrate aspects of an audio speaker of an electronic device. In an aspect, an audio speaker 106 includes an enclosure, such as a speaker housing 204, which supports a speaker driver 202. Speaker driver 202 can be a loudspeaker used to convert an electrical audio signal into a sound. For example, speaker driver 202 can be a micro speaker having a diaphragm 206 supported relative to housing 204 by a speaker surround 208. Speaker surround 208 can flex to permit axial motion of diaphragm 206 along a central axis 210. For example, speaker driver 202 can have a motor assembly attached to diaphragm 206 to move diaphragm 206 axially with piston-like motion, i.e., forward and backward, along central axis 210. The motor assembly can include a voice coil 212 that moves relative to a magnetic assembly 214. In an aspect, magnetic assembly 214 includes a magnet, such as a permanent magnet, attached to a top plate at a front face and to a yoke at a back face. The top plate and yoke can be formed from magnetic materials to create a magnetic circuit having a magnetic gap within which voice coil 212 oscillates forward and backward. Thus, when the electrical audio signal is input to voice coil 212, a mechanical force can be generated that moves diaphragm 206 to radiate sound forward along central axis 210 into a surrounding environment outside of housing 204.

Movement of diaphragm 206 to radiate sound forward toward the surrounding environment can cause sound to be pushed in a rearward direction. For example, sound can propagate through a gas filling a space enclosed by housing 204. More particularly, sound can travel through air in a back volume 216 behind diaphragm 206. Back volume 216 can influence acoustic performance. In particular, the size of back volume 216 can influence the natural resonance peak of audio speaker 106. For example, increasing the size of back volume 216 can result in the generation of louder bass sounds.

In an aspect, back volume 216 within housing 204 can be separated into several cavities. For example, back volume 216 can be separated by a permeable partition 222 into a rear cavity 218 and an adsorption cavity 220. Rear cavity 218 can be located directly behind speaker driver 202. That is, speaker driver 202 can be suspended or supported within rear cavity 218 so that sound radiating backward from diaphragm 206 propagates directly into rear cavity 218. Accordingly, at least a portion of rear cavity 218 can be defined by a rear surface of diaphragm 206, and similarly, by a rear surface of speaker surround 208. Furthermore, given that permeable partition 222 can extend across a cross-sectional area of back volume 216 between several walls of housing 204, rear cavity 218 can be further defined by an internal surface of housing 204 and a first side 224 of permeable partition 222.

Back volume 216 can include adsorption cavity 220 separated from rear cavity 218 by permeable partition 222—i.e., adsorption cavity 220 can be adjacent to rear cavity 218 on an opposite side of permeable partition 222. In an aspect, adsorption cavity 220 is defined by an internal surface of housing 204 that surrounds back volume 216, and can also be defined by a second side 226 of permeable partition 222. Thus, rear cavity 218 and adsorption cavity 220 can be immediately adjacent to one another across permeable partition 222.

In an aspect, adsorption cavity 220 can be placed in fluid communication with the surrounding environment through a fill port 228. For example, fill port 228 can be a hole through a wall of housing 204 that places adsorption cavity 220 in fluid communication with the surrounding environment. The port can be formed during molding of housing 204, or through a secondary operation, as described further below. To isolate adsorption cavity 220 from the surrounding environment, a plug 230 can be located in fill port 228, e.g., after filling adsorption cavity 220 with an adsorptive filler 232, to prevent leakage of the adsorptive filler 232 into the surrounding environment. Thus, adsorption cavity 220 can be partially defined by a surface of plug 230.

Audio speaker 106 can have a form factor with any number of shapes and sizes. For example, audio speaker 106, and thus housing 204, can have an external contour that appears to be a combination of hexahedrons, cylinders, etc. One such external contour could be a thin box, for example. Furthermore, housing 204 can be thin-walled, and thus, a cross-sectional area of a plane passing across housing 204 at any point can have a geometry corresponding to the external contour, including rectangular, circular, and triangular, etc. Accordingly, permeable partition 222 extending across back volume 216 within housing 204 can also have a variety of profile shapes. For example, in the case where audio speaker 106 is a hexahedron, e.g., a low-profile box having a rectangular profile extruded in a direction orthogonal to central axis 210, permeable partition 222 can have a rectangular profile.

Adsorptive filler 232 can be packaged in adsorption cavity 220 by directly filling, e.g., packing, adsorption cavity 220 with a loose adsorptive material and/or by coating inner surfaces of housing 204 with an adsorptive material. Directly filling adsorption cavity 220 can be distinguished from indirectly filling adsorption cavity 220 in that the loose adsorptive material can be poured, injected, or other transferred into adsorption cavity 220 in a loose and unconstrained manner such that the adsorptive material can move freely within adsorption cavity 220. That is, the adsorptive material can be constrained only by the walls that define adsorption cavity 220, e.g., an inner surface of housing 204, and not by a separate constraint, e.g., a bag, pouch, box, etc. that is filled with adsorptive material prior to or after inserting the separate constraint into adsorption cavity 220. In an aspect, at least a portion of the space of adsorption cavity 220 is filled with adsorptive filler 232, and at least a portion of an inner surface of housing 204 within adsorption cavity 220 is covered by adsorptive filler 232. The adsorptive filler 232 can be any appropriate adsorptive material that is capable of adsorbing a gas located in back volume 216. For example, adsorptive filler 232 can include acoustically active beads described below in connection with FIGS. 4A-4B and 5A-5B, which are configured to adsorb air molecules. The adsorptive material can be in a loose granular form. More particularly, the adsorptive filler 232 can include unbound particles that are able to move freely within adsorption cavity 220, e.g., the particles can shake around during device use. Thus, permeable partition 222 can act as a barrier to prevent adsorptive filler 232 from shaking out of adsorption cavity 220 into rear cavity 218 behind speaker driver 202.

FIG. 2B illustrates another aspect of an audio loudspeaker of an electronic device. Rear cavity 218 and adsorption cavity 220 can have different relative orientations in various aspects. For example, in the aspect shown in FIG. 2A, adsorption cavity 220 is located lateral to rear cavity 218, i.e., is laterally offset from rear cavity 218 away from central axis 210. As a result, sound emitted rearward from diaphragm 206 can propagate directly toward a rear wall of rear cavity 218, rather than be radiated directly toward permeable partition 222.

But in the aspect shown in FIG. 2B, audio speaker 106 includes axially arranged back volume 216 cavities. For example, adsorption cavity 220 can be located directly behind rear cavity 218, so that central axis 210 can intersect rear cavity 218 behind diaphragm 206 and adsorption cavity 220 on an opposite side of permeable partition 222. Accordingly, permeable partition 222 can cross back volume 216 along a plane such that normal vector 250 emerging from first side 224 and pointing into rear cavity 218 is oriented in a direction that is parallel to central axis 210. For example, rear cavity 218 and adsorption cavity 220 can each be flat and thin and positioned forward-and-behind along central axis 210. Thus, sound emitted rearward by diaphragm 206 can propagate along central axis 210 directly through rear cavity 218 and permeable partition 222 into adsorption cavity 220.

Permeable partition 222 can be oriented at any angle relative to central axis 210. That is, although first face can face a direction orthogonal to, or parallel to, central axis 210, in an aspect, permeable partition 222 is oriented at an oblique angle relative to central axis 210. Thus, adsorption cavity 220 can be some combination of lateral to, or directly behind, adsorption cavity 220 within the scope of this description. In any case, rear cavity 218 and adsorption cavity 220 can be adjacent to one another such that opposite sides of permeable partition 222 define a portion of each cavity.

Figure 3:
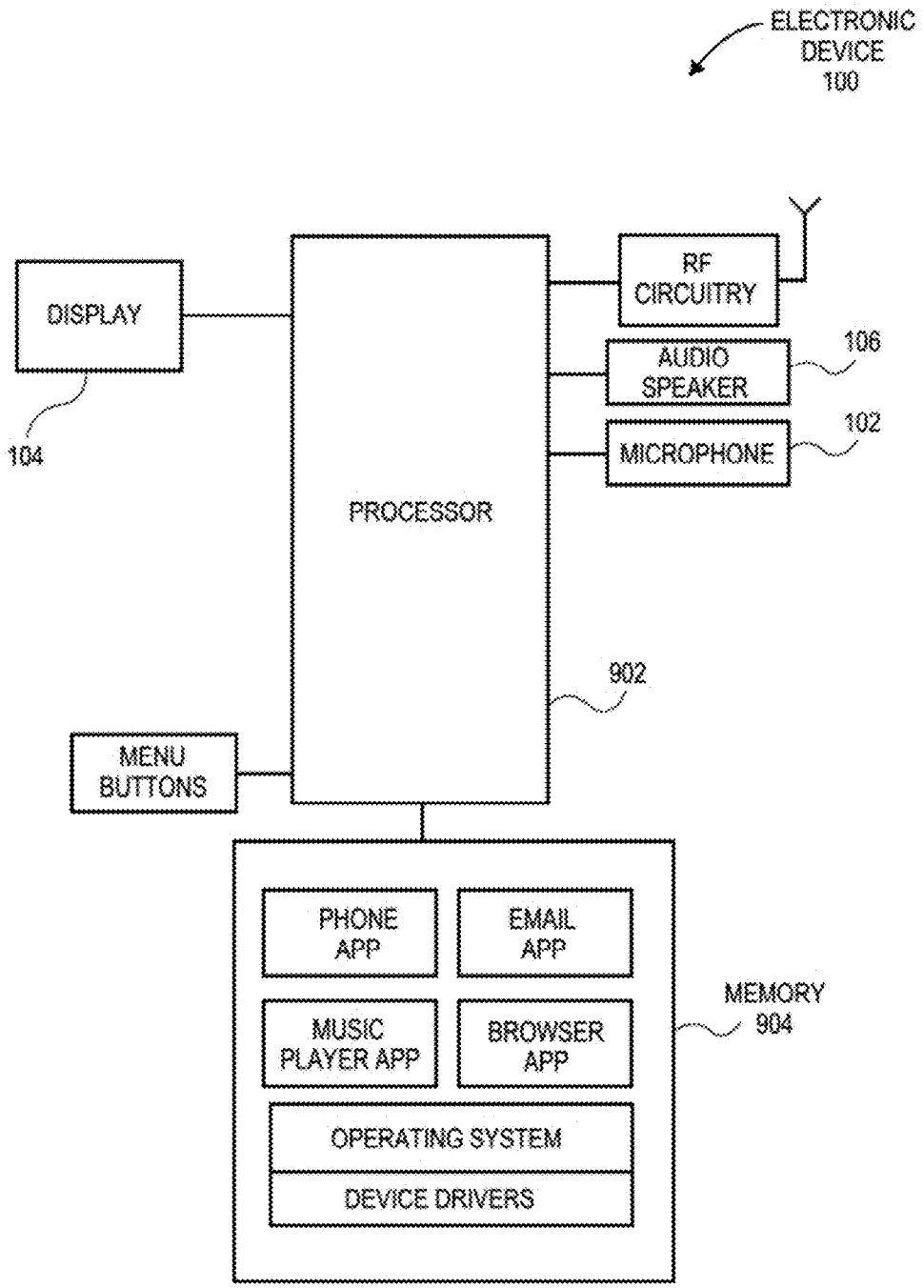
FIG. 3 is a schematic of an aspect of an electronic device including an aspect of an audio micro-speaker such as the ones shown in FIGS. 2A-2B.

FIG. 3 schematically illustrates an aspect of an electronic device that includes a micro speaker. As described above, electronic device 100 can be one of several types of portable or stationary devices or apparatuses with circuitry suited to specific functionality. Thus, the diagrammed circuitry is provided by way of example and not limitation.

Electronic device 100 can include one or more processors 902 that execute instructions to carry out the different functions and capabilities described above. Instructions executed by the one or more processors 902 of electronic device 100 can be retrieved from local memory 904, and can be in the form of an operating system program having device drivers, as well as one or more application programs that run on top of the operating system, to perform the different functions introduced above, e.g., phone or telephony and/or music play back. For example, processor 902 can directly or indirectly implement control loops and provide drive signals to voice coil 212 of audio speaker 106 to drive diaphragm 206 motion and generate sound.

Audio speaker 106 with the structure described above can include back volume 216 separated by an acoustically transparent barrier, e.g., permeable partition 222, into two cavities: rear cavity 218 directly behind speaker driver 202 and adsorption cavity 220 adjacent to rear cavity 218 across permeable partition 222. Furthermore, adsorption cavity 220 can be directly filled with an adsorptive material such that back volume 216 includes an adsorptive volume defined directly between a system housing 204 and the acoustically transparent barrier. The adsorptive volume can reduce the overall spring rate of back volume 216 and lower the natural resonance peak of audio speaker 106. That is, adsorptive filler 232 can adsorb and desorb randomly traveling air molecules as pressure fluctuates within back volume 216 in response to a propagating sound. As a result, audio speaker 106 can have a higher efficiency at lower frequencies, as compared to a speaker having a back volume 216 without adsorptive material. Thus, the overall output power of audio speaker 106 can be improved. More particularly, audio speaker output can be louder during telephony or music play back, especially within the low-frequency audio range. Accordingly, audio speaker 106 having the structure described above can produce louder, richer sound within the bass range using the same form factor as a speaker back volume without multiple cavities, or can produce equivalent sound within the bass range within a smaller form factor. Furthermore, because adsorption cavity 220 is defined directly between housing 204 and permeable partition 222, which are sealed together, the form factor of audio speaker 106 can be smaller than, e.g., a speaker back volume that holds a secondary container, e.g., a mesh bag, filled with an adsorbent material.

Back-Volume Configurations with Expandable Fillers

If a back volume is not entirely and densely filled with acoustically active beads, the use of beads can lead to a varying sound quality. This is mainly caused by undesirable movements of the beads inside the back volume. For example, upon changing the spatial orientation of a loudspeaker module, the sound quality might change because the beads occupy the lowest possible space inside the cavity. However, it is preferable to have constant sound quality regardless of the spatial orientation.

A simple approach to immobilize the acoustically-active beads would be to glue them together. But since the acoustically-active beads comprise a highly porous structure which is needed for improving the acoustic properties, it is impossible to glue them together and not lose acoustic performance. The bead's pores would be at least partly blocked by the glue because it would penetrate the pores and, when solidified, would hinder any gas transport through or gas storage in these pores. And, unfortunately, capillary forces favor such penetration of pores by glue—i.e., glue tends to block small pores of beads more likely than just immobilizing beads by gluing them together. Another approach to immobilize beads would be to fill the back volume completely. But in a production process slight variations of the filling density are extremely difficult to control and can hardly be avoided.

By numerous experiments performed by the inventors, it was shown that the addition to the bead assemblage a second kind of material comprising an expandable filler, and the expansion of this material, can prevent the bead assemblage from moving. By the correct amount of volume expansion of such material, the beads are compressed and/or squeezed together, so that they are immobilized. Thus, the variation of the sound quality because of the different spatial orientations of a loudspeaker can be mitigated or completely suppressed.

Figure 4A:
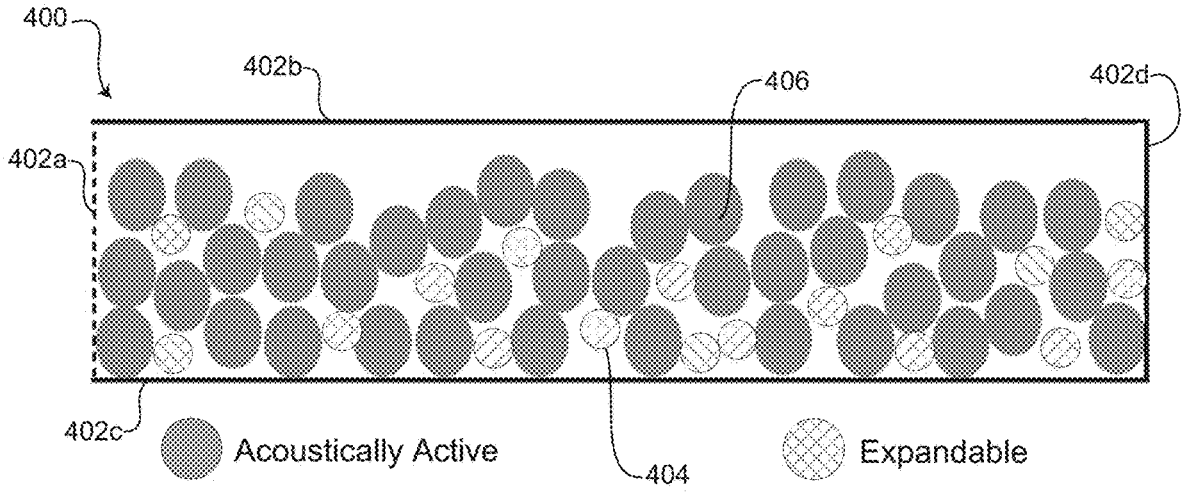
FIGS. 4A-4C are cross-sectional views of an aspect of an audio micro-loudspeaker back volume, such as the ones shown in FIGS. 2A-2B, with acoustically active beads and expandable beads.
Figure 4B:
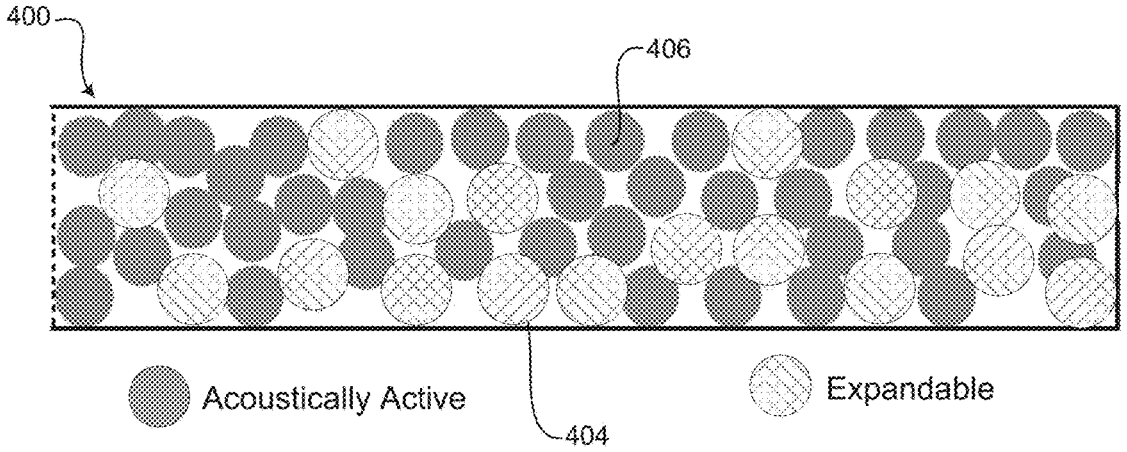
Figure 4C:
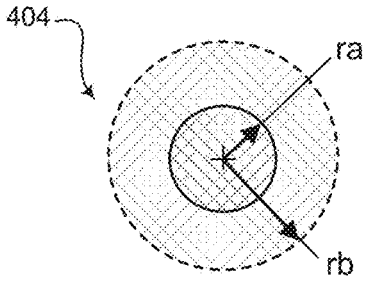

FIGS. 4A-4C illustrate an aspect an expandable filler including a plurality of expandable beads in an audio speaker back volume 400. FIG. 4A illustrates the expandable beads before expansion and FIG. 4B after expansion. FIG. 4C illustrates the expansion of a single expandable bead.

Back volume 400 is a three-dimensional space bounded by a plurality of walls 402*a*-402*d*. At least one of the walls, wall 402*a* in this instance, is porous so as to allow gas to flow in and out of the back volume. In the illustrated aspect back volume 400 is a hexahedron, but in other aspects it can be some other type of polyhedron, regular or irregular. In still other aspects, back volume 400 need not be a polyhedron but can instead be made up of a combination of curved surfaces, plane surfaces, or both.

Back volume 400 is filled partially by an expandable filler made up of a plurality of expandable beads 404 and partially filled by an acoustic filler comprising a plurality of acoustically active beads 406. Acoustically active beads 406 are those that have sorption properties that allow them to adsorb or desorb gases driven by the driver parts of the speaker into back volume 400 through porous wall 402*a*. In the illustrated aspect expandable beads 404 and acoustically active beads 406 have the same shape—both are spherical in this instance—but in other aspects the two types of beads need not have the same shape.

In one aspect, the average size of the plurality of expandable beads 404 is similar to the average size of the plurality of acoustically active beads 406, meaning that the sizes of the beads are within an order of magnitude of each other, in another aspect, are within 90-110% of each other. The density of expandable beads 404 is also similar to the density of acoustically active beads 406, meaning that their densities are within 90-110% of each other. When expandable beads 404 and acoustically active beads 406 are mixed inside back volume 400, or mixed before being inserted into the back volume, it is desirable for the expandable beads to be uniformly distributed among the acoustically active beads, or vice versa. Similarity of size and density of expandable beads 404 and acoustically active beads 406 can be desirable to reduce or prevent separation of the two types of beads when mixed; big differences in size or density can allow gravity or other inertial forces, such as those caused by shaking, to separate the two types of beads from each other. Having the expandable beads possess similar size and density as the acoustically active beads is also advantageous as the existing process for filling in the beads can be used without or with only minor modifications.

For example, a mixture of two kinds of spheres with at least an order of magnitude different sizes would rapidly separate on shaking, and the smaller spheres would fall through the voids between the larger ones and collect themselves in the bottom. In some aspects, however, it is possible to use expandable and acoustically active beads of different sizes and densities, for example, if the mixing of the both types of beads takes place directly before the filling of the loudspeaker back volume.

FIG. 4B illustrates expandable beads 404 in their expanded state. As further explained below, expandable beads 404 are formulated so that they permanently expand from a first dimension to a larger second dimension upon the application of an expansion trigger to the beads. The expansion trigger can be heat, light, electromagnetic radiation such as ultraviolet (UV) radiation, alternating magnetic fields, or some other trigger. When expandable beads 404 expand, they reduce the space into which acoustically active beads 406 are packed, exerting a mechanical force on the acoustically active beads and thus substantially reducing or eliminating movement or mobility of the acoustically active beads within back volume 400. Put differently, when expanded the expandable beads 404 partially or fully lock or fix acoustically active beads 406 into position. In one aspect, when expanded the expandable beads 404 can occupy between 0.5% and 20% of the back volume, e.g., more particularly between 1% and 2% of the back volume. The acoustically active beads occupy at least part of the remainder of the back volume. Persons skilled in the art will appreciate that the percentages of back volume 400 occupied by the expandable beads and the acoustically active beads will not add up to 100% of the back volume because of the presence of interstitial spaces between beads.

FIG. 4C illustrates the expansion of a single expandable bead 404. Upon application of the expansion trigger, bead 404 expands from radius ra to radius rb, and thus its volume increases from volume Va to volume Vb. Depending on formulation of the beads and the expansion factor defined by f=Vb/Va, with Vb being the volume after expansion and Va the volume before expansion, the free volume inside the back volume is reduced. The assemblage of a plurality of acoustically-active beads is squeezed together, resulting in a block in which all beads are mostly or totally fixed. Generally, the higher f is, the higher is the degree of fixation.

Acoustically active beads 406 can be any of various known formulations. In one aspect, they can have a formulation that includes a polymer binder and zeolite, but other bead formulations are possible. Examples of sorptive materials that can be used include zeolites, active carbon or metal organic frameworks (MOFs). Since the expandable formulation does not contribute to the increase of virtual volume which is the purpose of the zeolite beads, an optimum percentage of this formulation in the acoustic beads exist which allows a reasonable fixation and a satisfactory acoustic performance. It is advantageous to use between 0.5% and 20% by mass of the expandable formulation, more advantageous to use between 1% and 5% by mass of the expandable formulation, and the most advantageous is to use between 1% and 2% by mass of the expandable formulation.

Figure 5A:
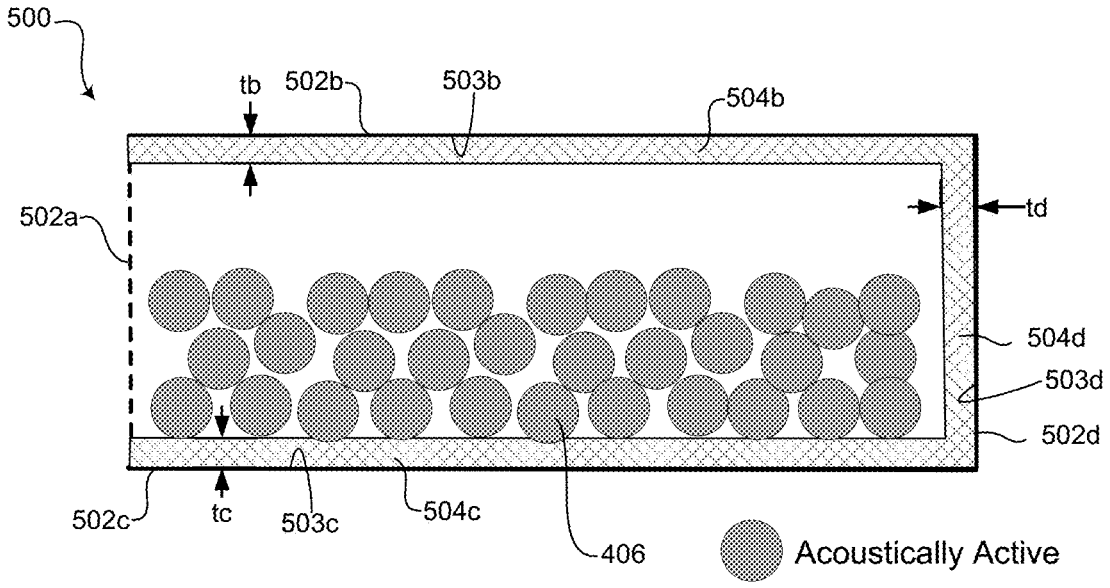
FIGS. 5A-5B are cross-sectional views of an aspect of an audio micro-loudspeaker back volume, such as the ones shown in FIGS. 2A-2B, with an expandable coating on the walls of the back volume.
Figure 5B:
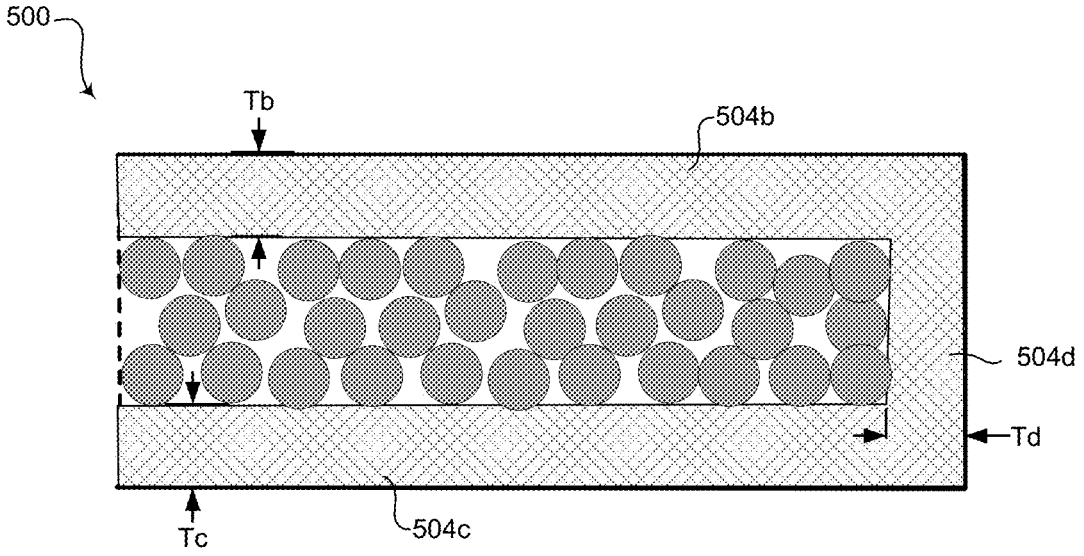

FIGS. 5A-5B illustrate another aspect in which an expandable filler can be applied into a back volume 500 as a layer or a sheet comprising expandable parts which can be laid into the back volume.

Like back volume 400, back volume 500 is a three-dimensional space bounded by a plurality of walls 502*a*-502*d*. Each of walls 502*b*-502*d* has an interior surface 503: wall 502*b* has interior surface 503*b*, wall 502*c* has interior surface 503*c*, and wall 502*d* has interior surface 503*d*. At least one of the walls, wall 502*a* in this instance, is porous so as to allow gas to flow in and out of the back volume. In the illustrated aspect back volume 500 is a regular hexahedron, but in other aspects it can be some other type of polyhedron, regular or irregular. In still other aspects, back volume 500 need not be a polyhedron, but can instead be made up of a combination of curved surfaces, plane surfaces, or both.

Back volume 500 is partially filled by an expandable filler comprising a plurality of expandable layers or sheets 504 deposited on the interior surfaces 503 of at least one wall 502. Back volume 500 is also partially filled by an acoustic filler including a plurality of acoustically active beads 406. Acoustically active beads 406 are those that have sorption properties that allow them to adsorb or desorb gases driven by the driver parts of the speaker into back volume 500 through porous wall 502*a*.

The illustrated aspect has layers 504 deposited on multiple interior surfaces: layer 504*b* is deposited on interior surface 503*b*, layer 504*c* is deposited on interior surface 503*c*, and layer 504*d* is deposited on interior surface 503*d*. Because wall 502*a* is porous, no layer 504 is deposited on its interior surface because it would prevent the flow of gas into and out of back volume 500. In other aspects, layers 504 can be positioned a greater or lesser number of interior surfaces 503 than shown, ranging from a single interior surface to every interior surface of the back volume except the interior surface of the back volume's porous wall.

FIG. 5B illustrates expandable layers 504 in their expanded state. As further explained below, expandable layers 504 are formulated so that they permanently expand from a first dimension t to a larger second dimension T upon application of an expansion trigger: layer 504*b* expands from thickness tb to thickness Tb, layer 504*c* expands from thickness tc to thickness Tc, and so on. The expansion trigger can be heat, light, electromagnetic radiation such as ultraviolet (UV) radiation, alternating magnetic fields, or some other trigger. When the layers 504 expand, they reduce the volume into which acoustically active beads 406 are packed, exerting a mechanical force on the acoustically active beads and thus substantially reducing or eliminating their movement or mobility within back volume 500. Put differently, when expanded, the layers 504 partially or fully lock or fix acoustically active beads 406 into position. In one aspect, when expanded the expandable filler can occupy between 0.5% and 20% of the back volume, and for example, more particularly, the expandable filler can be between 1% and 2% of the back volume. The acoustic filler occupies at least part of the remainder of the back volume. Persons skilled in the art will appreciate that the percentages of back volume 500 occupied by the expandable layers 504 and the acoustically active beads 406 will not add up to 100% of the back volume because of the presence of interstitial spaces between acoustically active beads.

Expandable Filler Manufacturing Process

Figure 6:
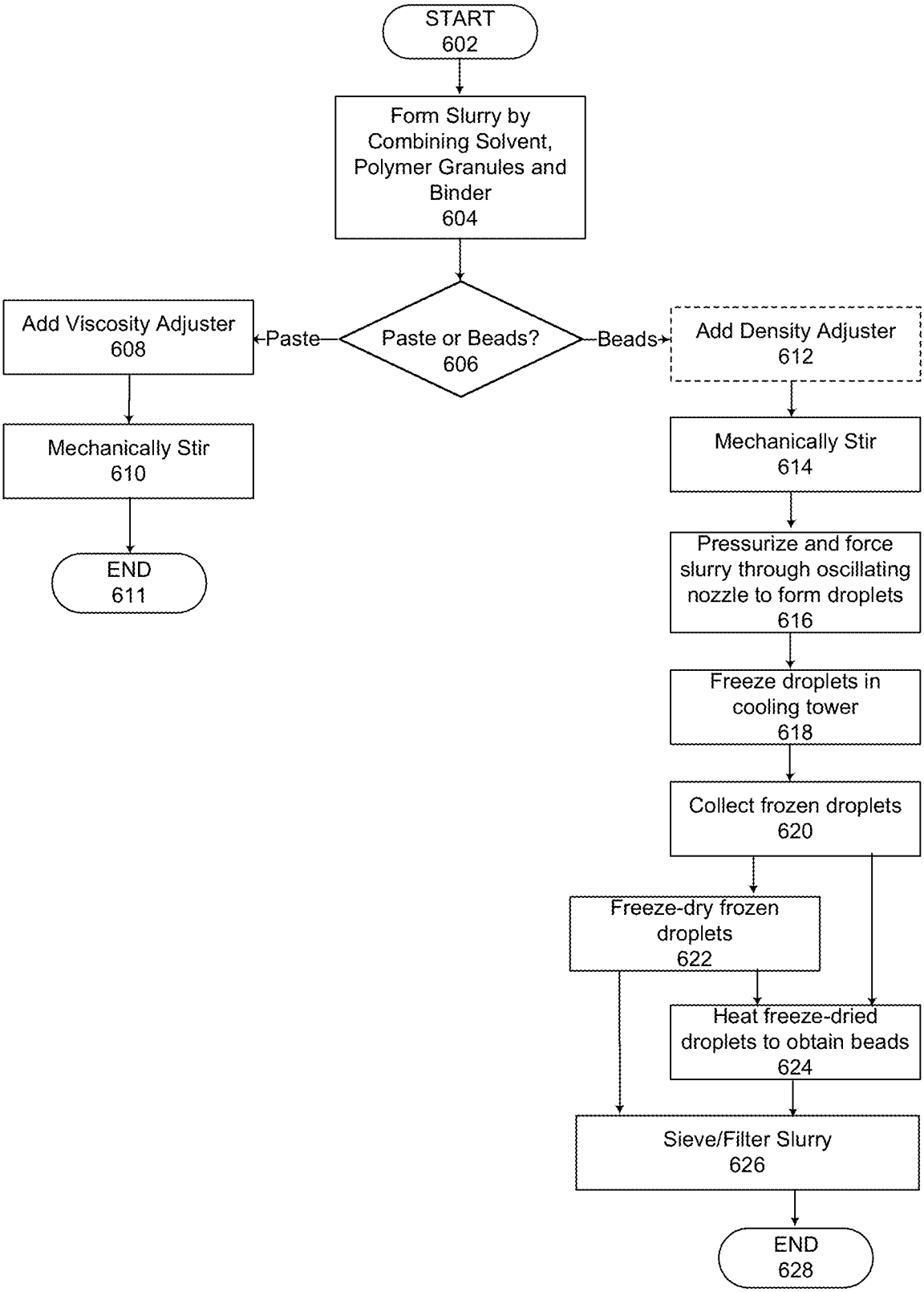
FIG. 6 is a flowchart of an aspect of a process for making an aspect of expandable material for the uses shown in FIGS. 4A-4C and 5A-5B.

FIG. 6 illustrates an aspect of a process 600 for making an expandable filler for an audio speaker back volume, such as the ones shown in FIGS. 4A-4B and 5A-5B. Blocks shown in dashed lines are optional. The process starts at block 602.

At block 604, an aqueous slurry (i.e., a semiliquid mixture of fine particles suspended in a solvent, in this case water) of an expandable polymeric material is formed by combining commercially available expandable polymer microspheres, optionally a density regulator, a solvent, and a polymeric binder. The binder can be a polyacrylic or polyurethane sol; unexpectedly, using a polymeric binder such as an acrylic or polyurethane sol leads to mechanically stable beads that retain their geometrical shape upon expansion.

At block 606, two different process options are available depending on whether the expandable filler will be a paste that can be used for coating the interior surface of a back volume, as in FIGS. 5A-5B, or whether it will be formed into expandable beads for use in the back volume, as shown in FIGS. 4A-4B. If the expandable material will be a paste, then at block 608 a thickener or viscosity-regulating compound is added to the slurry to adjust the viscosity of the slurry or to produce a stable gel. Slurries with a viscosity similar to glues used in commercial processes have the advantage that existing equipment for the application of glues can be used. In one embodiment the viscosity-regulating compound can be fumed silica, but in other aspects a different viscosity-regulating compound can be used. At block 610 the resulting slurry is mechanically stirred until thoroughly mixed. If the stirred mixture is not already the desired consistency, then it is allowed to rest or is otherwise processed to thicken it into a paste. The process ends at block 611

If the expandable filler will be expandable beads, then at optional block 612, a density-regulating compound is added to the slurry to adjust the density of the expandable beads to be similar to the density of the acoustically active beads with which they will be mixed. The density of such beads can be increased by adding to the slurry compounds of relatively high density, for example finely dispersed metal oxides. Oxides that can be used include, among others, Zinc oxide (ZnO), Tin oxide ($SnO_2$), Titanium oxide ($TiO_2$), Bismuth oxide ($Bi_2O_3$), Zirconium oxide ($ZrO_2$), or Hafnium oxide ($HfO_2$). The density of many oxides, especially the above-listed ones, is higher than the density of typical polymers, so that the addition of these oxides increases the density of the final beads.

At block 614 the slurry is mechanically stirred until thoroughly mixed. At block 616 the slurry is pressurized and forced through an oscillating nozzle to produce droplets of the slurry. For instance, the slurry can be pressurized with air and pushed through an oscillating nozzle with a suitable diameter, powered by an amplifier connected to a function generator. At block 618, the droplets emerging from the nozzle in block 616 are frozen, for instance by dropping them through a cooling tower. For instance, the droplets can be dropped into a cooling tower of ca. 3 meters height, cooled continuously by a mixture of nitrogen and air to a temperature in the top, for example, of −20±5° C. and in the bottom of −50±5° C.

At block 620 the frozen droplets are collected from the cooling tower and at the frozen droplets are freeze-dried at block 624 by subjecting them to a vacuum, to cause any remaining water in the droplets to sublimate. For instance, the frozen droplets can be collected in a round-bottom flask that was precooled to about −20° C. and subjected to a vacuum until the water (ice) was completely removed from the frozen droplets by sublimation, thus freeze drying the frozen droplets into beads. Additionally or instead of freeze-drying at block 622, the frozen droplets or freeze-dried beads can be collected and heated at block 624 to obtain the final beads. For instance, the freeze-dried beads can be collected on a steel tray, heated in a forced convection air oven to a suitable temperature, kept at that temperature for a certain amount of time, and then cooled.

At block 626 the beads are mechanically filtered or sieved to obtain beads similar in size to the acoustically active beads that will be used. The process ends at block 628. Further details of specific aspects of process 600 are given in examples 1-3 below.

Example 1

Into a 0.5 L beaker were placed 100.0 g of acrylic emulsion, 56.0 g of deionized water, 34.0 g of fine zinc oxide, 2.00 g of 15% KOH solution, and 33.0 g of F-48D expandable microspheres. The slurry was stirred for 1 hour and dropped using an electronically controlled oscillating nozzle into an excess of liquid nitrogen. The frozen droplets were freeze-dried and sieved to obtain the fraction with pellet diameter 0.355-0.400 mm. A small fraction of about 100 mg was separated from the batch and when heated to 115° C. for about 2 min, the bead volume expanded several fold without losing their round shape and integrity.

Example 2

Into a 0.5 L beaker were placed 100.0 g of acrylic emulsion, 60.0 g of deionized water, 32.0 g of fine zinc oxide, 2.00 g of 15% KOH solution, and 35.0 g of EML101 expandable microspheres. The slurry was stirred for 1 h, and dropped using electronically controlled oscillating nozzle into an excess of liquid nitrogen. The frozen droplets were freeze-dried and sieved to obtain the fraction with beads diameter 0.355-0.400 mm. A small fraction of about 100 mg was separated from the batch and heated to 115° C. for about 2 min, the bead volume expanded several fold without losing their round shape and integrity.

The beads obtained as above were mixed with acoustically active beads in ratio of 1:49, and a back volume of a loudspeaker was filled with this mixture. The relative amount of the expandable beads should, on one hand, be sufficient to fix the acoustic beads after the expansion, on the other hand, as the expandable beads are neutral material, it should not be too large to diminish significantly the acoustic performance of the whole assemblage. The loudspeaker was heated several minutes at 115° C., and its acoustic performance in horizontal and vertical was measured. The loudspeaker containing the expanded beads demonstrated the same performance independently on its spatial orientation.

Example 3

In a beaker, to 5.00 g acrylic emulsion was added 0.15 g of fumed silica (particle size <7 nm), and 5.00 g of F-48D expandable microspheres. The components were carefully mixed with a spatula to obtain a thick paste. About 40 mg of such paste was placed as a stripe in the corner of the back volume of a loudspeaker, and dried at 70° C. for 1 h. The back volume of the loudspeaker was filled with the acoustic beads, sealed and heated for several minutes at 115° C. The loud-speaker with the expanded stripe in the back volume demonstrated the same performance in vertical and horizontal positions.

Figure 7:
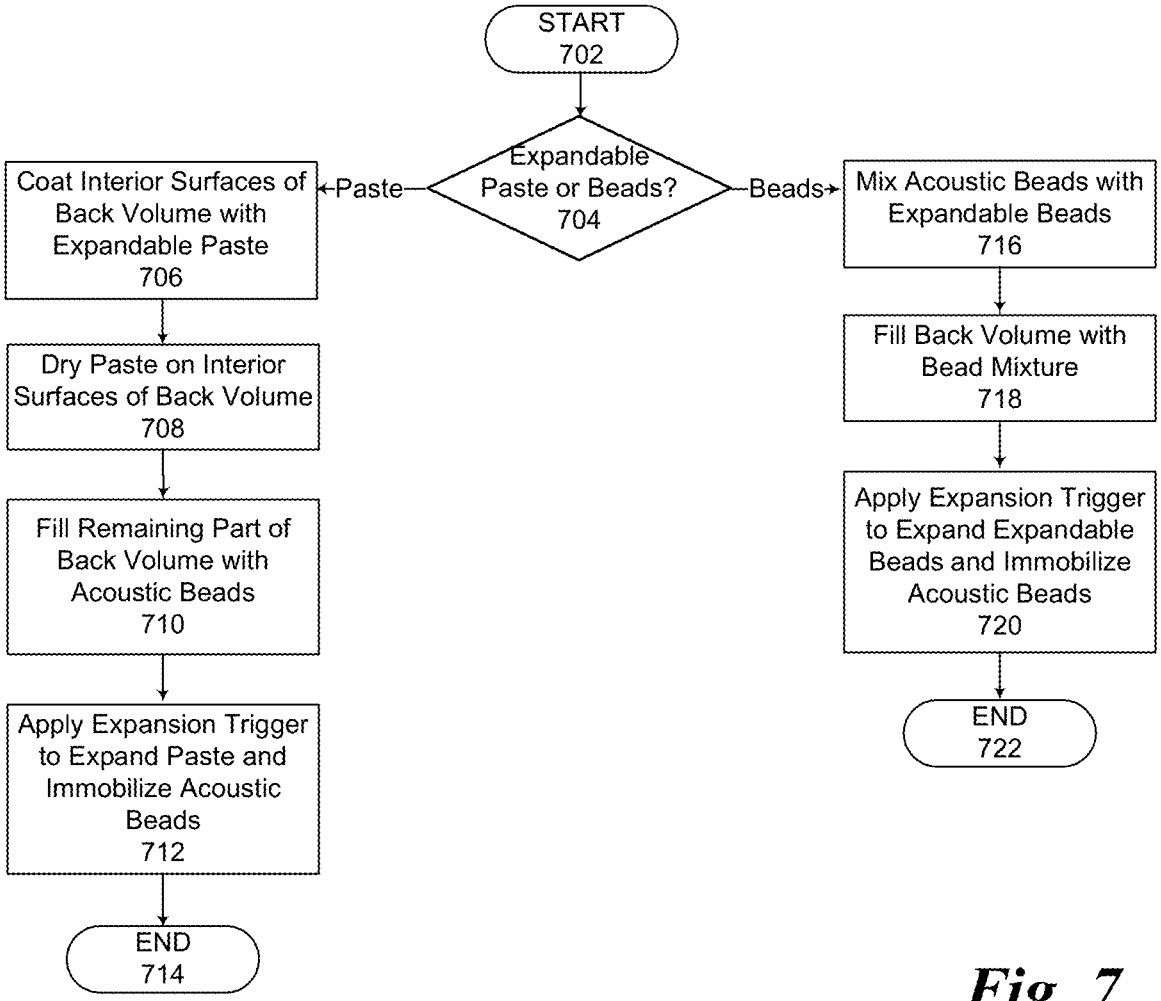
FIG. 7 is a flowchart of an aspect of a process for using an expandable material for the uses shown in FIGS. 4A-4C and 5A-5B.

FIG. 7 illustrates an aspect of a process 700 by which an expandable filler can be used in an audio speaker back volume. The process starts at block 702. At block 704, different process options are available depending on whether the application will use a paste to coat an interior surface of a back volume, as in FIGS. 5A-5B, or will use expandable beads in the back volume, as shown in FIGS. 4A-4B.

If a paste will be used to coat interior surfaces of the back volume, then at block 706 the paste is deposited as an expandable layer or sheet on at least one interior surface of the back volume (see FIGS. 5A-5B). The application of the paste can be done by various means, such as doctor blading, jetting, or printing. Using such a paste is advantageous because the location of the unexpanded and then expanded material can be precisely determined, whereas in the mixture of expandable beads and acoustically active beads the expansion takes place statistically throughout the mixture of acoustically active and expandable beads.

At block 708, the deposited expandable layers are allowed to dry on the surfaces on which they were deposited, and at block 710 the remaining part of the back volume is filled with acoustically active beads. The back volume is then closed so that the acoustically active beads do not flow out. At block 712 the expansion trigger is applied to the back volume to cause the expandable layers to permanently expand, thus constricting the acoustically active beads into a smaller volume and substantially immobilizing them. The expansion trigger can be heat, but other triggers as, for example, electromagnetic waves or an alternating magnetic field are also possible. The process ends at block 714.

If expandable beads will be used in the back volume, then at block 716 the expandable beads are mixed with the acoustically active beads in the desired ratio. At block 718, the bead mixture is inserted into the back volume (see FIGS. 4A-4B) and the back volume is then closed so that the beads do not flow out. In other aspects of the process, the expandable beads can be inserted into the back volume before or after acoustically active beads are inserted. At block 720 the expansion trigger is applied to the back volume to cause the expandable beads to permanently expand, thus constricting the acoustically active beads into a smaller volume and substantially immobilizing them. The expansion trigger can be heat, but other triggers as, for example, electromagnetic waves or an alternating magnetic field are also possible. The process ends at block 722.

Results

FIGS. 8A-8D are a perspective views and three cross-sectional views illustrating orientations of a simplified representation of a back volume 800 of an audio speaker in a smartphone such as an iPhone. The representation of back volume 800 does not necessarily represent the exact shape of the back volume, but instead illustrates three back volume orientations used to test whether the immobilized acoustically active beads are effective in maintaining uniform sound from an audio speaker.

Figure 8A:
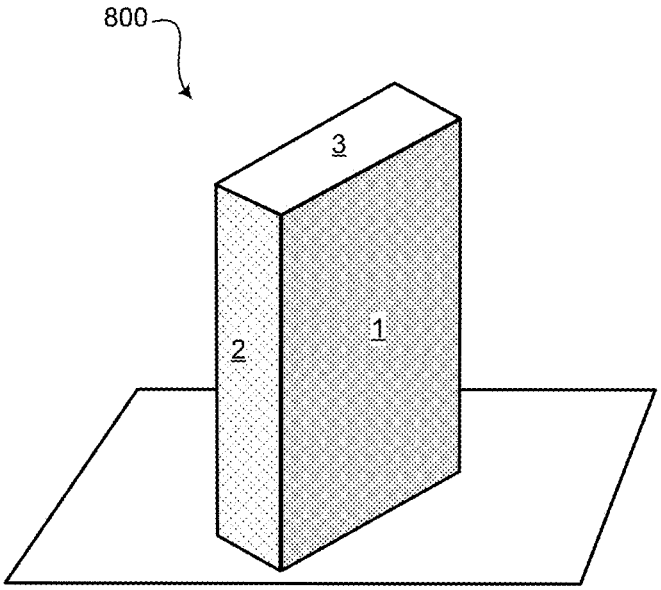
FIGS. 8A-8D are a perspective view and a series of side views of a simplified embodiment of a back volume, illustrating different orientations of the back volume.
Figure 8B:
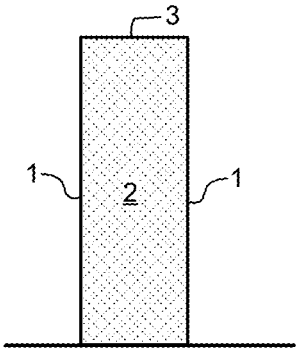
Figure 8C:
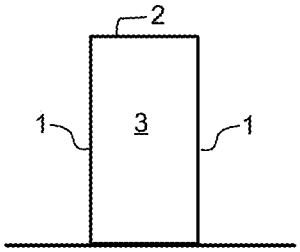
Figure 8D:
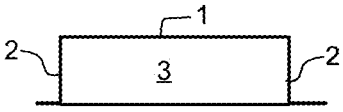

Volume 800 is hexahedral and has three pairs of surfaces: a pair of surfaces 1 with maximum area, a pair of surfaces 3 with minimum area, and a pair of surfaces 2 with an area in between surfaces 1 and 3. FIGS. 8B-8D illustrate the three orientations used. In FIG. 8B, surfaces 3 are horizontal, while surfaces 1 and 2 run vertically. In FIG. 8C, surfaces 2 are horizontal while surfaces 1 and 3 run vertically. And in FIG. 8D, surfaces 1 are horizontal while surfaces 2 and 3 run vertically.

Figure 9:
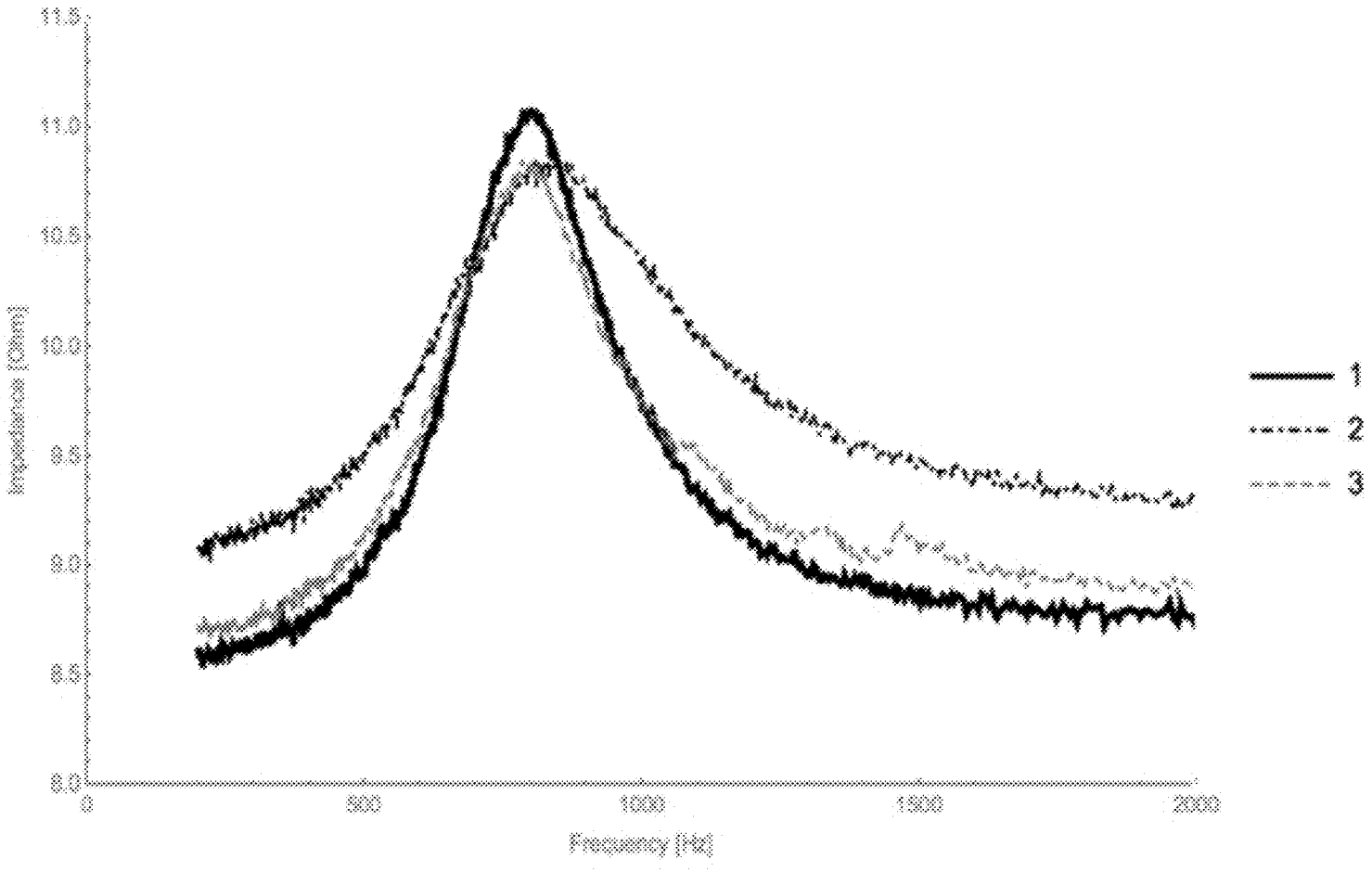
FIG. 9 is a graph illustrating the resonance frequency shift produced by the back volume orientations shown in FIGS. 8A-8D when the back volume is without expandable beads.

FIG. 9 illustrates the loudspeaker performance of a loudspeaker (e.g., micro-speaker) whose back volume includes no expandable filler. A loudspeaker back volume built from transparent plastics was filled with acoustically active beads—but not very densely, so that the beads could slightly move inside during shaking—and was sealed. The acoustic performance in various spatial orientations was measured. In the vertical position (FIG. 8B), a small free space in the loudspeaker back volume appeared after some time, as the beads assemblage slightly densified on having been shaken by acoustic waves. The loud-speaker acoustic performance in vertical (FIG. 8B) and horizontal (FIG. 8D) orientations was therefore different.

FIG. 9 shows the electric impedance plotted against the frequency of a loudspeaker module filled with acoustical active beads in three different orientations. Curve 1 was recorded with the module in the orientation of FIG. 8B; curve 2 was recorded with the module in the orientation of FIG. 8D; and curve 3 was recorded with the same spatial alignment as used for curve 1 but with the opposite surface 3 at the top. Variations in the resonance frequency were recorded to be as high as 74 Hz by a change of the loudspeaker orientation.

Figure 10:
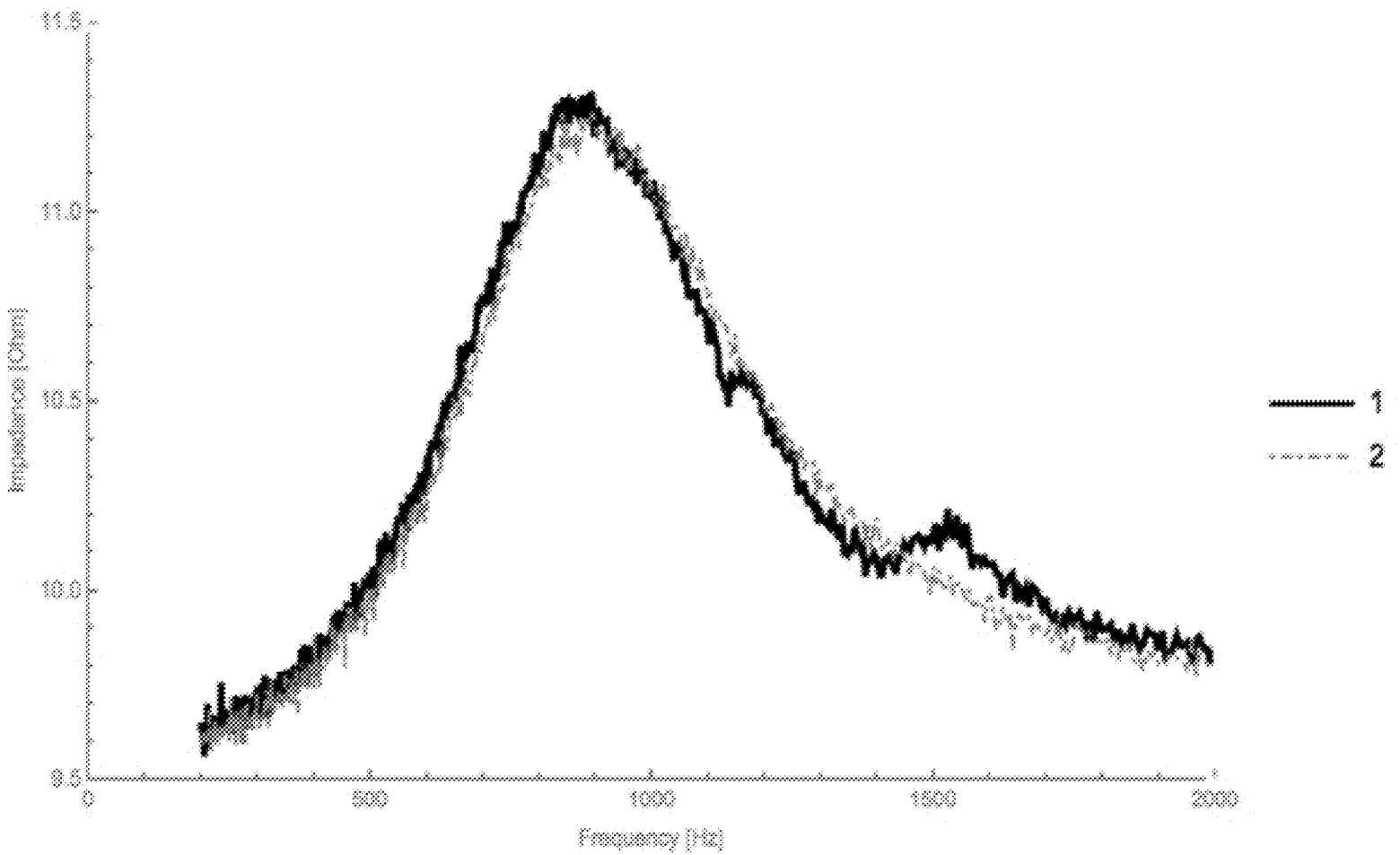
FIG. 10 is a graph illustrating the resonance frequency shift produced by the back volume orientations shown in FIGS. 8A-8D when the back volume has expandable beads.

FIG. 10 illustrates results of using the expandable filler shown in FIGS. 4A-4B. The diagram shows the electrical impedance plotted against the frequency of a loudspeaker module filled with a mixture of acoustical active beads and expanded beads in two different orientations.

The expandable beads obtained from Example 1 above in the unexpanded state were mixed with acoustically active beads in a ratio between 1:4 and 1:200. A back volume of a loudspeaker was filled with this mixture and sealed. The loudspeaker was heated for several minutes at a temperature sufficient to trigger the expansion of the beads, and its acoustic performance in horizontal and vertical orientations was measured. The expandable beads fixed the acoustically active bead assemblage and prevented the acoustically active beads from gathering in one part of the loudspeaker back volume. The loudspeaker containing the expanded beads demonstrated the same performance independently on its spatial orientation. Curve 1 was recorded with the module in the orientation of FIG. 8D, while curve 2 was recorded with the orientation of FIG. 8B. The curves are within measurement errors and in the low frequency region below 1000 Hz are substantially identical.

The above description of aspects is not intended to be exhaustive or to limit the invention to the described forms. Specific aspects of, and examples for, the invention are described herein for illustrative purposes, but various modifications are possible. To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. A filler for occupying a volume, the filler comprising:

an acoustic filler positioned in the volume of an electronic device so that the acoustic filler can adsorb gas flowing into the volume, the acoustic filler comprising a plurality of acoustically active beads;

an expandable filler positioned with the acoustic filler in the volume so that it occupies a percentage of the volume, wherein the expandable filler can permanently expand from a first dimension to a second dimension upon exposure to an expansion trigger to affect mobility of the acoustic filler, and wherein the expandable filler comprises a plurality of expandable beads mixed with the acoustically active beads.

2. The filler of claim 1 wherein the expandable filler comprises an expandable coating positioned on at least one interior surface of the volume.

3. The filler of claim 1 wherein a density of the expandable beads is within 90-110% of a density of the acoustically active beads.

4. The filler of claim 1 wherein an average size of the plurality of expandable beads is within an order of magnitude of an average size of the plurality of acoustically active beads.

5. The filler of claim 1 wherein the expandable filler occupies between 0.5% and 20% of the volume.

6. The filler of claim 1 wherein the expandable filler occupies between 1% and 2% of the volume.

7. The filler of claim 1 wherein the expansion trigger is heat, light, or ultraviolet radiation.

8. An electronic device comprising:

an audio speaker to transduce electronic signals into sound;

a back volume coupled to the audio speaker, the back volume being positioned behind a speaker driver of the audio speaker;

a filler for occupying the back volume, the filler comprising:

an acoustic filler positioned in the back volume so that the acoustic filler can adsorb gas flowing into the back volume, the acoustic filler comprising a plurality of acoustically active beads, and an expandable filler positioned with the acoustic filler in the back volume so that it occupies a percentage of the back volume, wherein the expandable filler can permanently expand from a first dimension to a second dimension upon exposure to an expansion trigger to affect mobility of the acoustic filler, and wherein the expandable filler comprises a plurality of expandable beads mixed with the acoustically active beads; and a processor coupled to the audio speaker and to a memory, the memory having stored therein one or more application programs including instructions that, when executed by the processor, transmit electronic signals to the audio speaker.

9. The electronic device of claim 8 wherein the expandable filler comprises an expandable coating positioned on at least one interior surface of the back volume.

10. The electronic device of claim 8 wherein a density of the expandable beads is within 90-110% of a density of the acoustically active beads.

11. The electronic device of claim 8 wherein an average size of the plurality of expandable beads is within an order of magnitude of an average size of the plurality of acoustically active beads.

12. The electronic device of claim 8 wherein the expandable filler occupies between 0.5% and 20% of the back volume.

13. The electronic device of claim 8 wherein the expandable filler occupies between 1% and 2% of the back volume.

14. The electronic device of claim 8 wherein the expansion trigger is heat, light, or ultraviolet radiation.

15. The electronic device of claim 8 wherein the electronic device is a smartphone, a tablet, or a laptop computer.

16. The electronic device of claim 8 wherein the application programs include one or more of a telephony application, a voicemail application, a sound playback application, an e-mail application, an internet browsing application, a scheduling application, and a photo application.

17. The electronic device of claim 8, further comprising one or more of a microphone coupled to the processor, radio frequency (RF) circuitry coupled to the processor, or a display coupled to the processor.

* * * * *